US005800881A

United States Patent [19]

Etzion

[11] Patent Number: 5,800,881

[45] Date of Patent: Sep. 1, 1998

[54] DECORATIVE BOW

[76] Inventor: Rafael Etzion, 15 Henhawk Rd., Great Neck, N.Y. 11024

[21] Appl. No.: 811,778

[22] Filed: Mar. 6, 1997

[51] Int. Cl.[6] ..... D04D 7/10

[52] U.S. Cl. ..... 428/5; 428/364

[58] Field of Search ..... 428/4, 5, 364

[56] References Cited

U.S. PATENT DOCUMENTS

| | | | |
|---|---|---|---|
| 2,104,248 | 1/1938 | Stark | 428/5 |
| 5,100,706 | 3/1992 | Zaweski | 428/4 |
| 5,198,274 | 3/1993 | Etzion | 428/5 |

*Primary Examiner*—Henry F. Epstein
*Attorney, Agent, or Firm*—Robin, Blecker & Daley

[57] ABSTRACT

A decorative bow is formed of six discrete pieces of ribbon, including a first piece formed into a loop, second and third pieces each formed into a respective bow loop and gathered, a fourth piece of ribbon gathered but not formed into a loop, and fifth and sixth pieces both respectively gathered and folded to form angled drape members. A fastener inserted through the loop formed by the first piece of ribbon is twisted to secure together all six pieces of ribbon. A mounting rod secured to the decorative bow includes attachment tabs at respective ends of the mounting rod.

15 Claims, 9 Drawing Sheets

DECORATIVE BOW

FIELD OF THE INVENTION

This invention relates to decorative accessories, and more particularly, to decorative bows formed from segments of ribbon.

BACKGROUND OF THE INVENTION

It is well known to form decorative bows from segments of ribbon. A prior art bow design, suitable for use as a decorative accent during the Christmas holiday season and on other occasions, is illustrated in FIGS. 11 and 12. The prior art decorative bow 20 shown in FIG. 11 is made up of a first bow-loop 22, a second bow-loop 24, an angled drape member 26 and a fastener 28. The component parts of the bow 20 are shown in dis-assembled form in FIG. 12. Each of the bow-loops 22 and 24 is typically formed from a respective discrete loop of ribbon that has been folded into a loop and gathered at a central point. A third discrete length of ribbon is gathered at a central point and folded at an acute angle to form the angled drape member 26. The fastener 28 typically has a wire-core with an external surface formed of a decorative material. The fastener 28 is employed to fasten the pieces 22, 24 and 26 together in common at the narrowest points of the respective gathered portions of the three pieces.

Bows of the type shown in FIG. 11 are undoubtedly attractive items, but even more pleasing and visually impressive decorative accessories are to be desired.

OBJECTS AND SUMMARY OF THE INVENTION

It is an object of the invention to provide a decorative bow that is more visually satisfying than prior bow designs.

It is a more particular object of the invention to provide a decorative bow that satisfyingly adorns a horizontally extensive space.

A still more particular object of the invention is to provide a decorative bow that has an improved visual impact when applied to a mantel or the top of a doorframe or window-frame.

According to an aspect of the invention, there is provided a decorative bow formed of at least four, and preferably six, discrete pieces of ribbon, with a fastening member for securing the pieces of ribbon together. Preferably three of the pieces of ribbon are formed into respective loops, including two gathered bow-loops and a small loop through which the fastener is inserted. A fourth piece is in the form of a substantially straight but gathered large background or swag piece and the fifth and sixth pieces are centrally-gathered angled drape pieces.

According to a further aspect of the invention, a plastic mounting rod is secured to the rear of the decorative bow.

DESCRIPTION OF PREFERRED EMBODIMENTS

Figure 1:
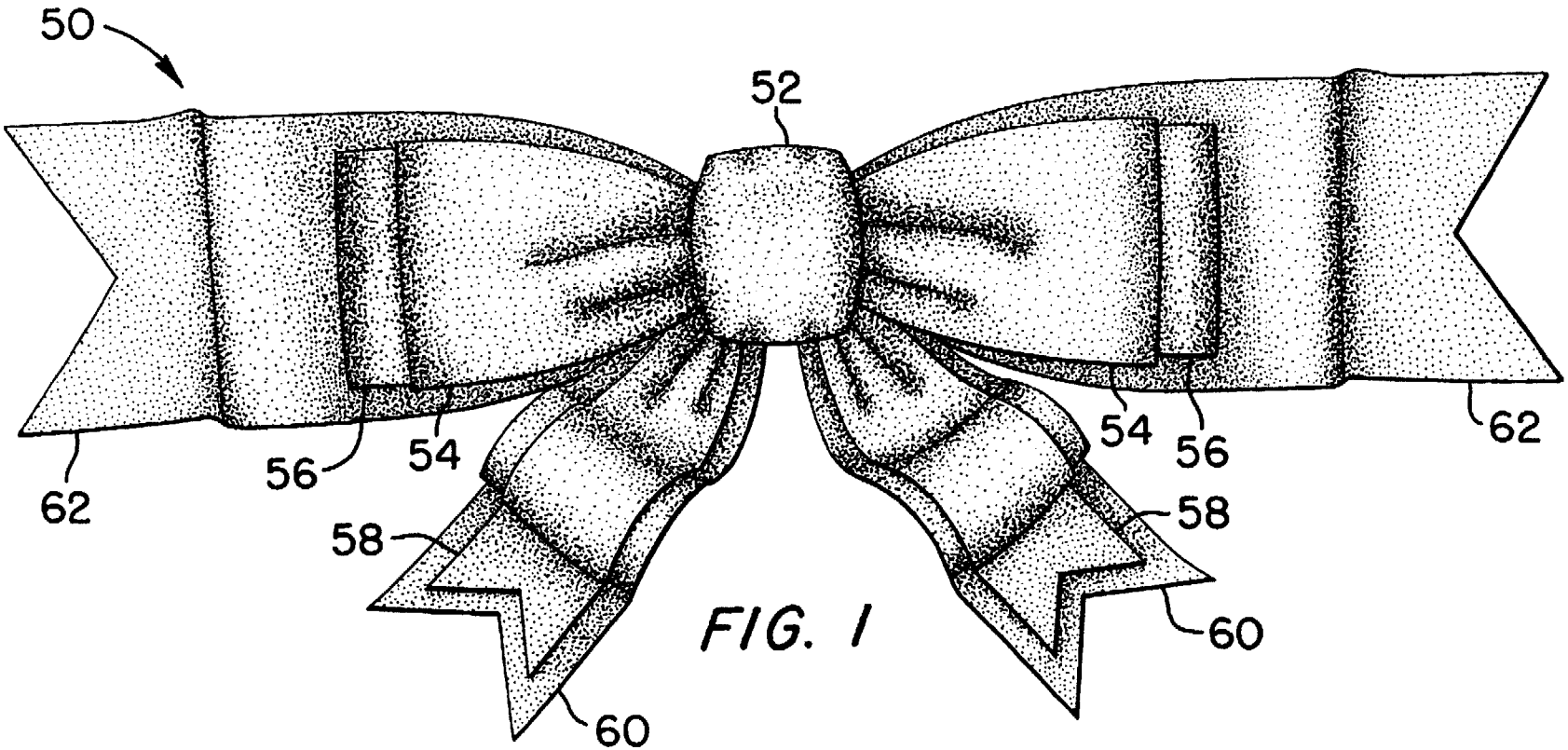
FIG. 1 is a front elevational view of a decorative bow provided in accordance with the present invention.
Figure 2:
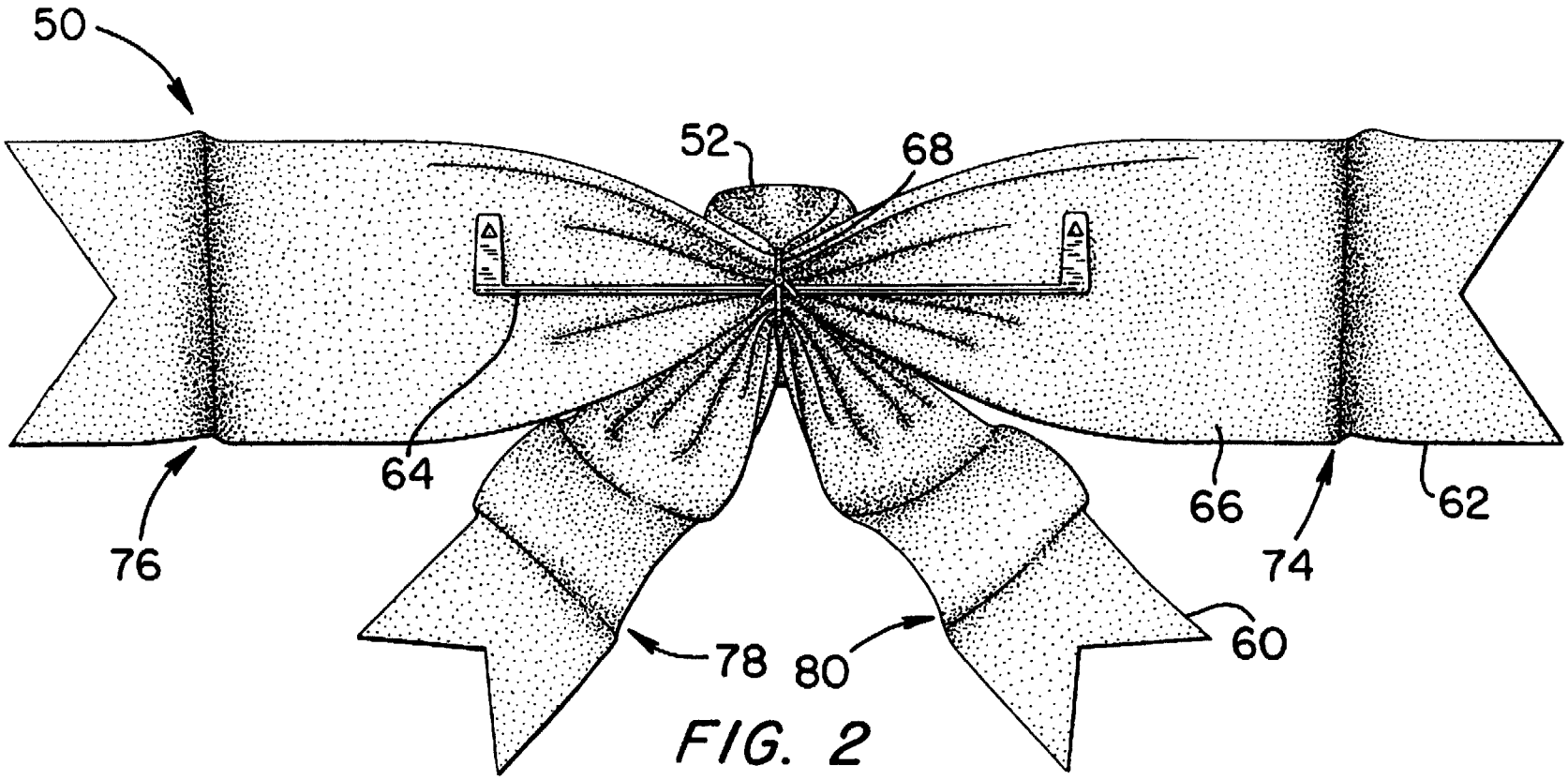
FIG. 2 is a rear elevational view of the bow of FIG. 1, including a view of a mounting rod for the bow.

A decorative bow provided in accordance with the invention is shown in front view in FIG. 1 and is indicated generally by reference numeral 50. The rear view of bow 50 is seen in FIG. 2. The bow 50 includes a puffed-loop 52 at a central portion of the bow 50. Extending to either side of the puffed-loop 52 are bow loops 54 and 56, with the bow loop 56 stacked behind bow loop 54.

Extending downwardly from the puffed-loop 52 are angled drape members 58 and 60, with the drape member 60 arranged overlapping with and behind the drape member 58. Provided behind the bow loops 54 and 56 is a backing or swag member 62. A mounting rod 64 (FIG. 2) is provided at a reverse side 66 of the swag member 62. A wire-core fastener 68, inserted through the loop 52, is twisted so as to secure together the elements 52, 54, 56, 58, 60, 62 and 64 which comprise the decorative bow 50.

Figure 5:
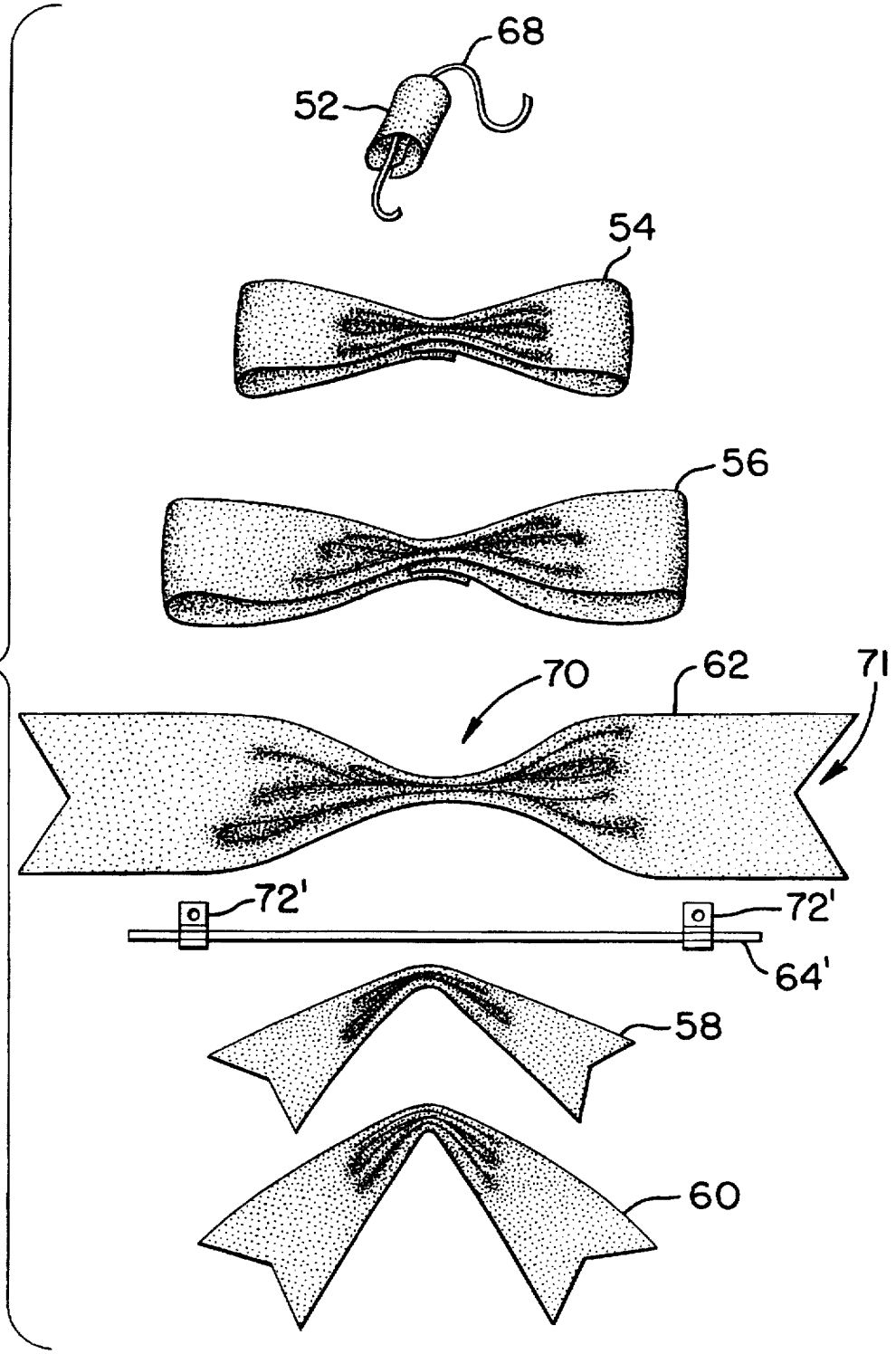
FIG. 5 is a dis-assembled view of the components from which the bow of FIG. 1 is constructed.

The decorative bow 50 of FIGS. 1 and 2 is shown in dis-assembled form in FIG. 5 (except that an alternative embodiment 64' of the mounting rod is shown in FIG. 5 instead of the preferred mounting rod 64 shown in FIG. 2). As seen from FIG. 5, the bow 50 is constructed from six discrete pieces of ribbon. Preferably, all six pieces are of the same color or colors. Preferred dimensions of the pieces of ribbon are as follows: the first piece, used to form the puffed-loop 52, is 3¼" by 7¾"; the second piece, from which the bow loop 54 is formed, is 4" by 30"; the third piece, from which bow loop 56 is formed, is 4" by 35"; the fourth piece, used as the swag member 62, is 6" by 35"; the fifth piece, used for the forward drape member 58, is 3" by 22"; and the sixth and last piece, used for the rearward drape member 60, is 4" by 24".

When ribbon pieces using the above dimensions are employed, the resulting bow has overall dimensions of about 31" wide and 14" high, after ornamental ripples are formed in the fourth, fifth and sixth pieces. It is contemplated to scale up or down these dimensions to produce a larger or smaller bow, and/or to adjust the proportions of the bow.

A manner of assembling the bow 50 is as follows. The first piece of ribbon is folded to form the puffed-loop 52. Each of the second and third pieces is folded into a loop and gathered at a central portion to form, respectively, the bow loops 54 and 56. Preferably, the respective ends of each of the pieces making up the elements 52, 54 and 56 are secured to each other by stapling. The fourth piece (largest piece) is gathered at a central portion as shown at 70 in FIG. 5. The bow loop 56 is centered and stacked on the swag member 62; the bow loop 54 is centered and stacked on the bow loop 56; and the puffed-loop 52 is centered and stacked on the bow loop 54. (According to an alternative, and preferred, sequence of steps, gathering of the bow loops 54 and 56, and of the swag member 62, is performed in a single operation, after the loops 54, 56 have been sacked on the member 62.)

The fifth piece of ribbon is folded to form an angle and gathered at a central portion and the sixth piece of ribbon is similarly treated, and then the resulting drape member 58 corresponding to the fifth piece of ribbon is stacked on the drape member 60 corresponding to the sixth piece of ribbon so that the drape member 60 is provided behind and totally overlapping with the drape member 58. (It should be understood that the members 58 and 60 may be angled and gathered in a combined operation after member 58 is stacked on member 60.) The drape members 58 and 60 are then brought in proximity to the swag member 62 with the gathered portions of the members 58 and 60 immediately below the gathered portion of the swag member 62. It will be observed that the ends of the fourth, fifth and sixth pieces of ribbon each have a respective angle cut-out, as indicated at 71, for example, in FIG. 5.

The angle formed in the fourth and fifth pieces is less than 180°, and may be somewhat less than 90°, as seen from FIG. 1.

The fastener 68 is inserted through the puffed-loop 52 and is tied around all of the six pieces of ribbon as well as the mounting rod 64, which is positioned rearwardly of the swag member 62. The mounting rod 64 is also preferably further secured to the swag member 62 by means of stapling through the attachment tabs 72 provided at opposite ends of the rod 64. The stapling of the attachment tabs 72 may also extend through one thickness of the rearward bow loop 56.

The ribbon stock used for the six pieces discussed above may be of a conventional type, but preferably includes reinforcing wire extending longitudinally along the ribbon pieces to provide support for the bow and to permit controlled rippling of the various members, as shown, for example, at 74, 76, 78 and 80 in FIG. 2.

Figure 3:
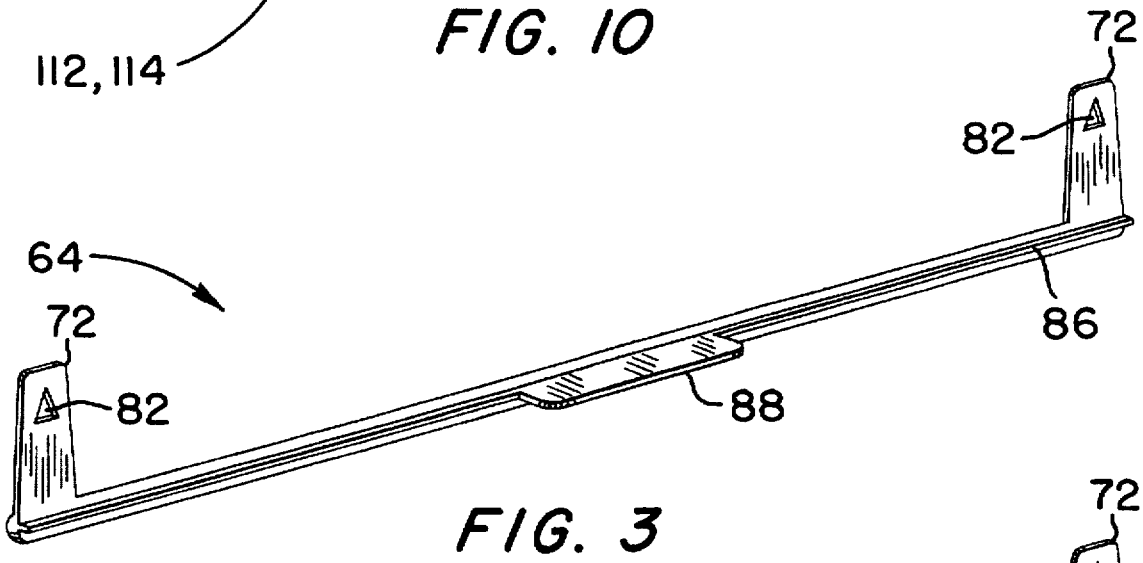
FIG. 3 is a rear side perspective view of the mounting rod seen in FIG. 2.
Figure 4:
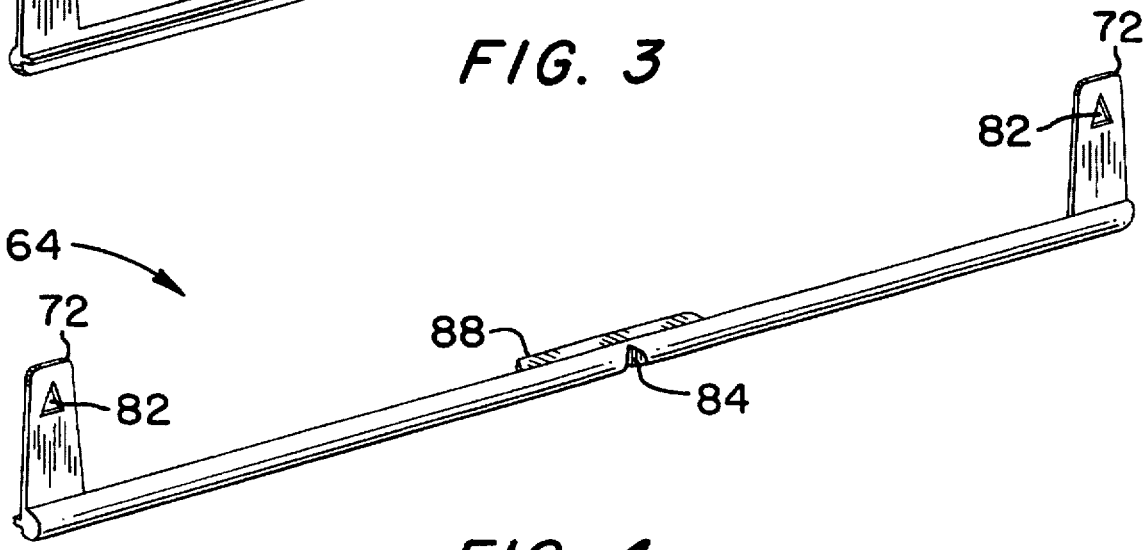
FIG. 4 is a front side perspective view of the mounting rod.

The preferred form of the mounting rod 64 is shown in more detail in FIGS. 3 and 4. Preferably, the mounting rod 64 is a single integrally-formed molded plastic piece, that includes attachment tabs 72 at respective ends of the mounting rod 64. A respective triangular aperture 82 is formed in each of the attachment tabs 72. At a central portion of the front side of the mounting rod 64 there is provided a vertically extending notch 84 for accommodating the fastener 68 (FIG. 2) when the fastener 68 is tied around all of the elements of the bow 50. A rib 86 extends horizontally rearwardly from a rear side of the mounting rod 64 and includes a relatively wide tab 88 at a central portion of the rod 64 opposite to the notch 84. The tab 84 is to be inserted into a gather at the rear side of the swag member 62 to aid in stabilizing the bow 50 relative to the mounting rod 64. Except for the rib 86, the tab 88, the notch 84, and the attachment tabs 72, the mounting rod 64 is substantially semi-circular in cross section, although other cross-sectional shapes, including a round cross section, are contemplated.

It is contemplated to form the rod 64 otherwise than as a single integral piece. For example, as seen in FIG. 5, an alternative embodiment 64' of the mounting rod may be formed of a cylindrical rod with discrete tab members 72' adhered to respective opposite ends of the cylindrical rod.

It is also contemplated that one or both of the rib 86 and tab 88 shown in FIG. 3 may be a separate piece glued to the main body of the mounting rod 64.

PACKAGING FOR THE BOW

Figure 6:
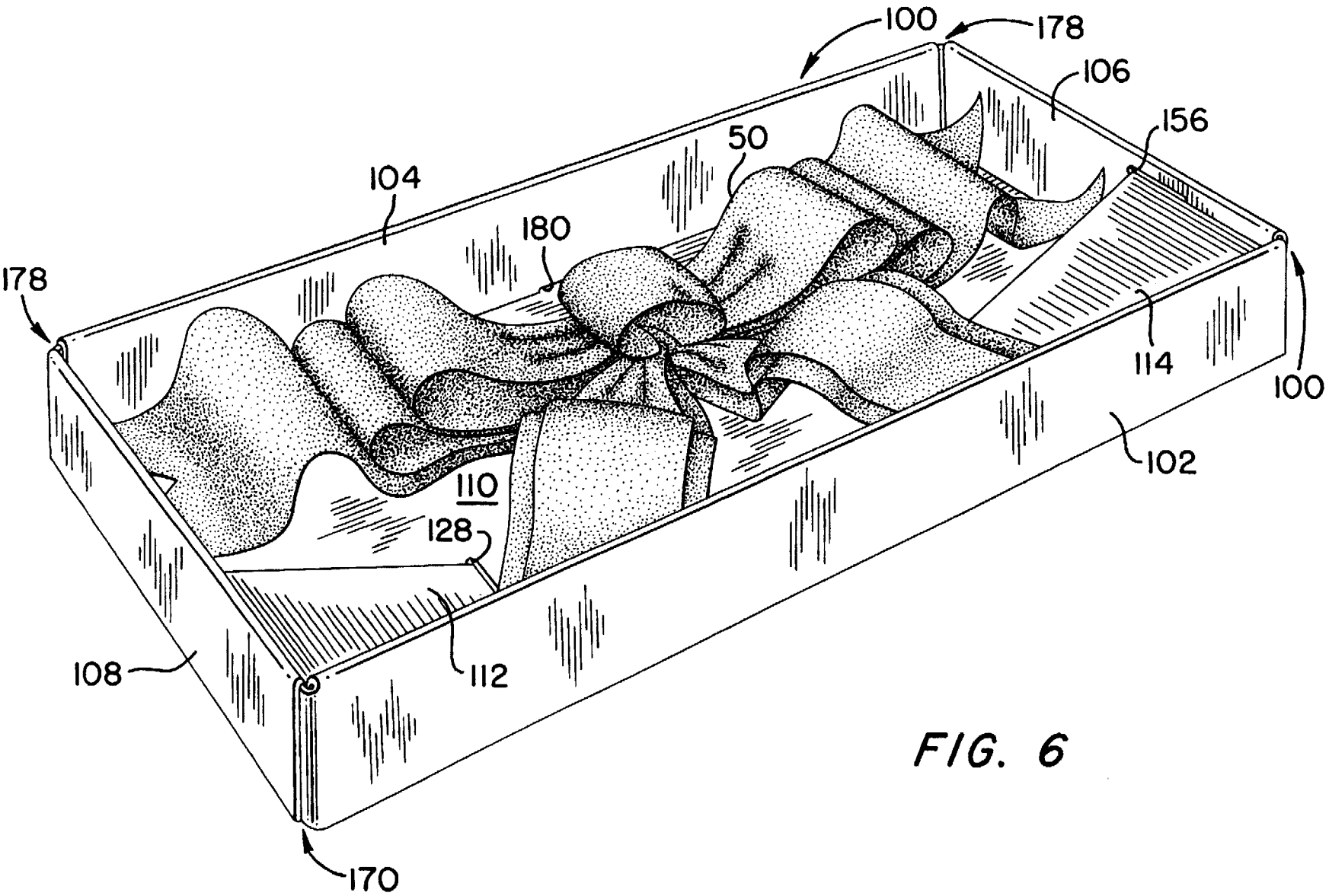
FIG. 6 is a perspective view of the bow of FIG. 1, mounted for shipment and display in a display box provided in accordance with the invention.

FIG. 6 shows the bow 50 mounted for shipment and display within an open-topped display box 100 that is provided in accordance with the invention. The shipment and display structure for the bow 50 includes four pieces, including the box 100 (which includes long walls 102 and 104 and short walls 106 and 108 and a bottom wall, not shown in FIG. 6, which is orthogonal to the walls 102–108), a mounting card 110 to which the bow is directly mounted and which is parallel to and rests on the bottom wall of the box 100, plus corner cards 112 and 114 which secure the mounting card 110 to the box 100.

Figure 7:
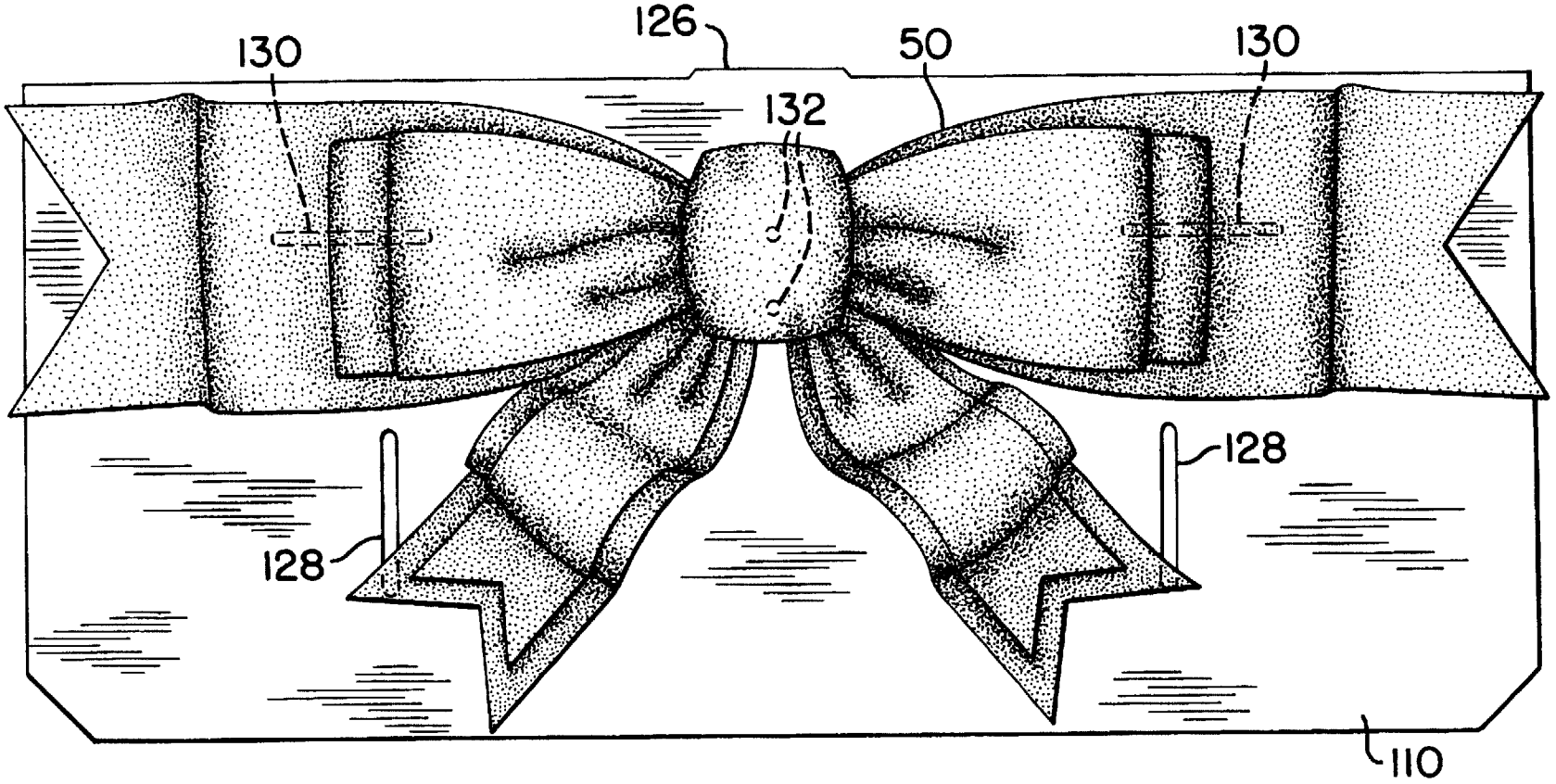
FIG. 7 is a view of the bow of FIG. 1 secured to a mounting card appointed for insertion into the display box of FIG. 6.
Figure 9:
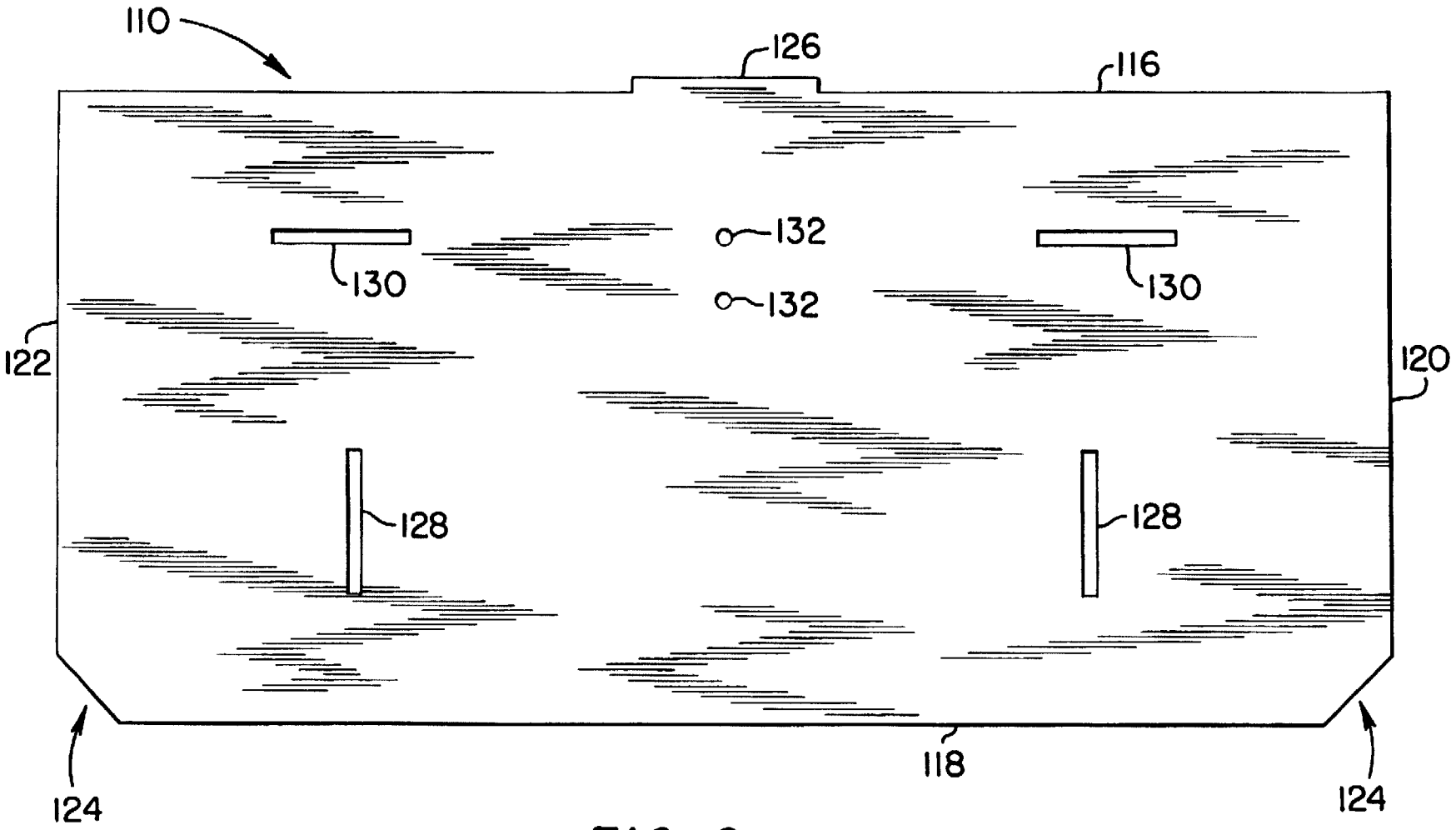
FIG. 9 is a plan view of the mounting card of FIG. 7.
Figure 12:
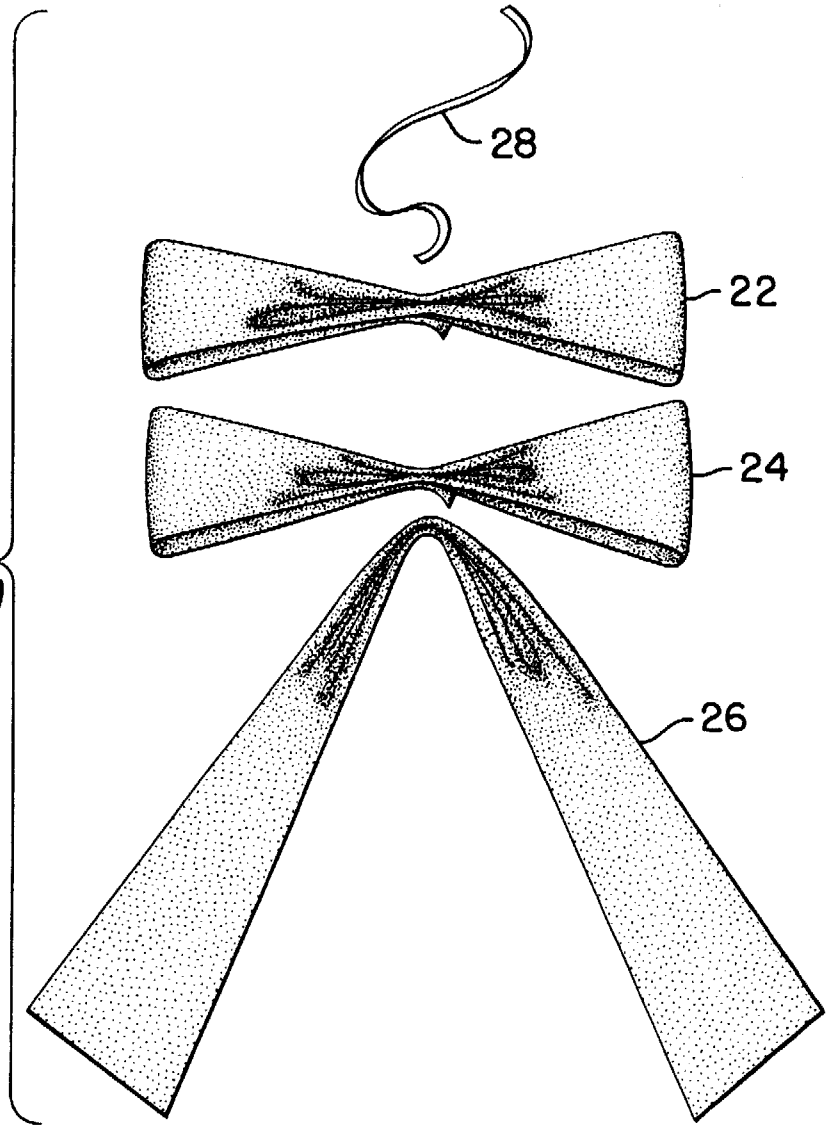
FIG. 12 (PRIOR ART)
FIG. 12 is a dis-assembled view of the components used to form the bow of FIG. 11.
Figure 11:
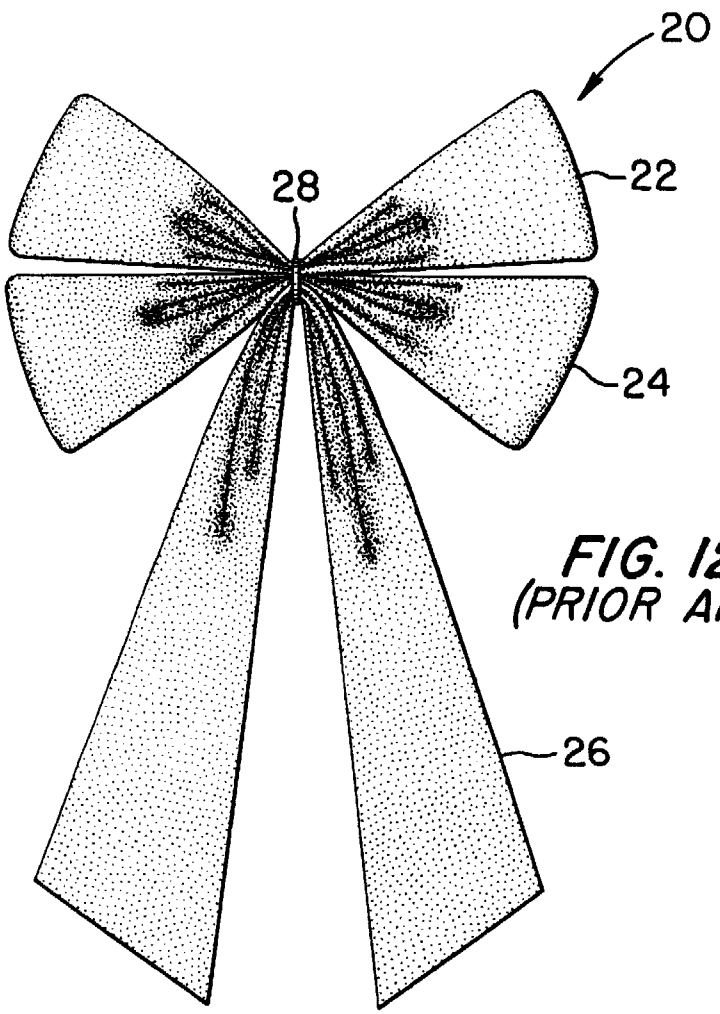
FIG. 11 (PRIOR ART)
FIG. 11 is a front elevational view of a decorative bow provided in accordance with the prior art.

A plan view of the mounting card is shown in FIG. 9, and a similar view of the mounting card is shown in FIG. 7 with the bow 50 mounted on the mounting card. The mounting card 110 is substantially planar and rectangular and has long edges 116 and 118 and short edges 120 and 122. There are diagonal corner cuts at the corners 124 of the long edge 118 to form obtuse angles at each of the corners 124. A short tab 126 extends outwardly in the plane of the card 110 from a central portion of the long edge 116. Vertically extending slots 128 are provided spaced apart from each other in a lower portion of the card 110. A respective horizontally extending slot 130 is provided spaced vertically above each of the vertical slots 128. A pair of circular apertures 132 is provided at a midpoint between the horizontal slots 130, with the apertures 132 spaced vertically from each other.

As will be seen, each of the apertures 132 is for receiving a respective free end of the wire-core fastener 68 of the bow 50. Each of the horizontal slots 130 is for receiving a respective one of the attachment tabs 72 of the mounting rod 64. Each of the vertical slots 128 is for receiving a tab of a respective one of the corner cards 112 and 114. The corner cuts at the corners 124 are to aid in removing the mounting card 110 from the open box 100 upon unpacking the bow 50 from its shipment and display structure, and the short tab 126 on the long edge 116 is for insertion into a slot in the open-topped box 100.

The length and width of the card 110 are preferably slightly less than the internal length and width of the box 100, so that the card 110 may be snugly inserted in the box 100 in an orientation parallel to the bottom wall of the box 100.

Figure 8:
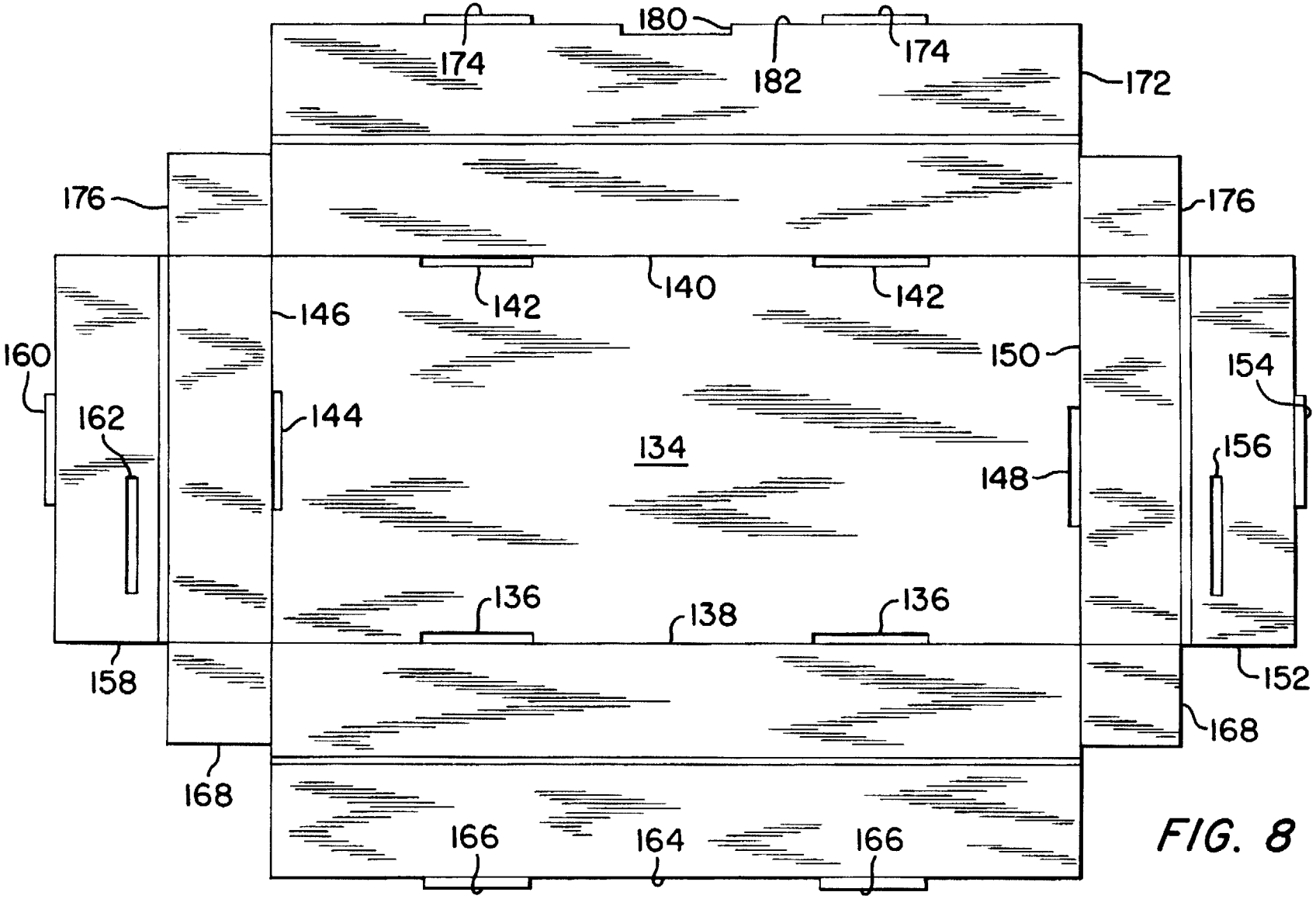
FIG. 8 is a plan view of a cardboard form from which the box of FIG. 6 is constructed.

FIG. 8 shows a plan view of a cut cardboard member which is folded to form the open-top box 100 of FIG. 6. Continuing to refer to FIG. 8, the cardboard member thereof includes a central, substantially rectangular panel 134 which corresponds to the bottom wall of the box 100. Slots 136 are formed at and parallel to a bottom edge 138 of the panel 134. At a top edge 140 of the panel 134, slots 142 are formed. A slot 144 is formed at a left side edge 146 of the panel 134, and a slot 148 is formed at a right side edge 150 of the panel 134.

Extending from right edge 150 is a folding flap 152 which is to be folded inwardly upon itself so that a tab 154 on the flap 152 is inserted into slot 148. When so folded, the flap 152 forms wall 106 (FIG. 6) of the box 100. A slot 156 formed in flap 152 is for receiving a tab of corner card 114. A folding flap 158 extends from edge 146 and is foldable to form wall 108 (FIG. 6) by folding inwardly upon itself with tab 160 inserted in slot 144. A slot 162, formed in flap 158, is provided to receive a tab of the corner card 112.

A folding flap 164 extends downwardly from the bottom edge 138 of central panel 134. The folding flap 164 is to be folded in upon itself with tabs 166 inserted into slots 136 to form wall 102 of box 100. Connecting flaps 168 extend outwardly from folding flap 164 for insertion into the side walls 106 and 108, as shown at 170 in FIG. 6.

Folding flap 172 extends from the top edge 140 of the central panel 134 and is foldable inwardly upon itself, with tabs 174 inserted in slots 142, so as to form the wall 104 of box 100. Connecting flaps 176 extend outwardly from the folding flap 172 for insertion into the side walls 106 and 108 as indicated at 178 in FIG. 6. A cut-out 180 extends along a top edge 182 of the flap 172. The cut-out 180 forms a slot at the base of wall 104 when the flap 172 is folded over to form wall 104. This slot is for receiving the above-mentioned tab 126 of mounting card 110.

Preferably both the box 100 and the mounting card 110 are formed of corrugated cardboard.

Figure 10:
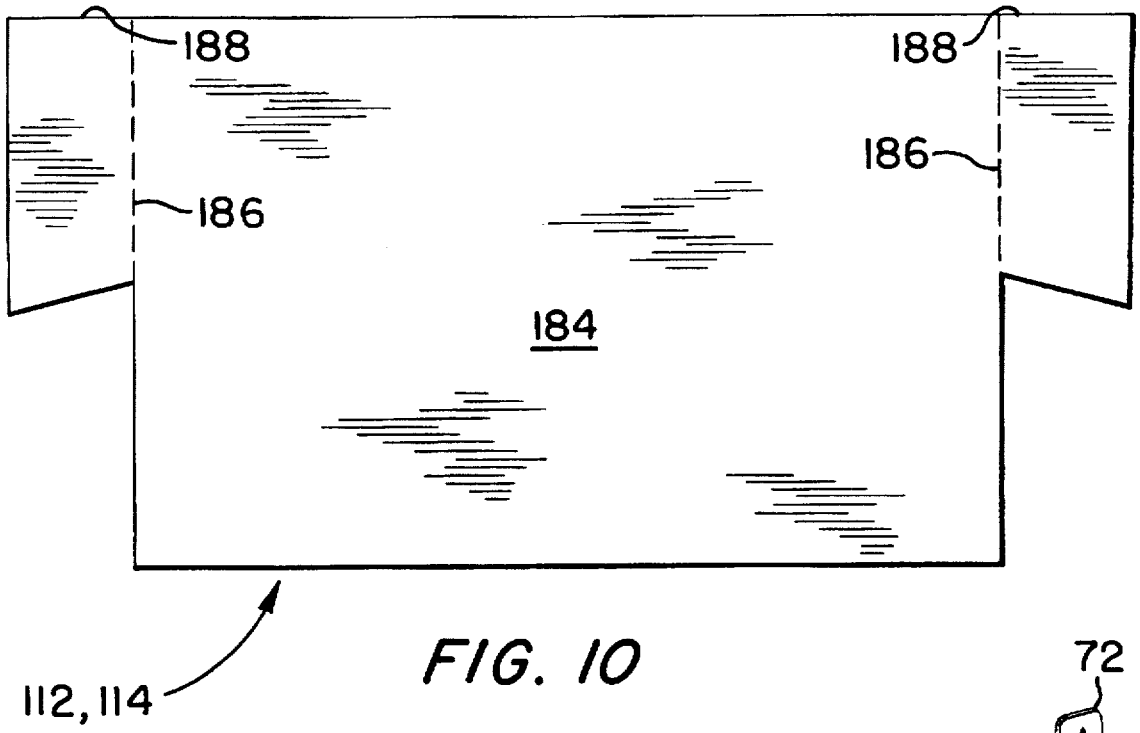
FIG. 10 is a plan view of a securing card member used to secure the mounting card to the display box.

The corner cards 112 and 114 preferably have a common configuration, which is shown in FIG. 10. Each corner card has a substantially rectangular central body 184 connected by folds 186 to tabs 188. The corner cards 112, 114 are preferably formed of rather thin, single-ply card stock. Promotional information or the like may be printed on the main bodies 104 of one or both of the corner cards.

After assembly, the bow 50 may be prepared for shipment and/or display according to the following procedure. The box 100 is formed by folding inward the flaps 158, 172, 152 and 164 to form the walls 108, 104, 106 and 102 of the box 100. Attachment tabs 72 of the mounting rod 64 of the bow 50 are inserted into slots 130 of the mounting card 110. The free ends of the wire-core fastener 68 of the bow 50 are inserted into respective ones of the apertures 132 of mounting card 110, and are twisted together at a rear side of the card 110 to secure the bow 50 to the card 110. The card 110, with the bow 50 secured thereto, is inserted into the box 100 so that the card 110 comes to rest against the bottom wall (originally panel 134) of the box 100 with the card 110 parallel to the bottom wall of box 100 and tab 126 of card 110 inserted into the slot formed at the base of wall 104 by the slot 180 (FIG. 6).

The left hand tab 188 of corner card 112 is inserted into the slot 162 (FIG. 8, not seen in FIG. 6) of the side wall 108 of box 100, while the right-hand tab 188 of corner card 112 is inserted into the left-hand slot 128 of the mounting card 110. Also, the right-hand tab 188 of corner card 114 is inserted into the slot 156 in the side wall 106 of box 100, while the left-hand tab 188 of corner card 114 is submitted into the right-hand slot 128 of mounting card 110. As seen from FIG. 6, the corner cards 112 and 114 are inclined downwardly toward the mounting card 110 from walls 108 and 106, respectively. The packaging structure for the bow 50 is now completely assembled, and the bow 50 is securely mounted in the box 100 for shipment and/or display.

When the bow 50 is to be removed from its packaging for use as a decorative ornament, the following procedure is followed. The corner cards are removed, and the mounting card 110 is grasped at both of its cut-out corners 124 to slideably remove the card 110 from the box 100. The twisted ends of the fastener 160 are untwisted and drawn out of the apertures 132 so as to free the bow 50 from the mounting card 110. The bow 50 may now be mounted by means of the attachment tabs 72 of the mounting rod 64. For example, the apertures 82 of the tab 72 may each be positioned to receive a respective mounting hook mounted on a wall, mantel, doorframe, etc.

The decorative bow provided in accordance with the invention makes a particularly pleasing visual impression, especially when mounted in a horizontally-extended space, as on a mantel or doorframe. The bow of the present invention is also suitable for many other ornamental purposes, including centerpieces for holiday tables, decoration on gift boxes (particularly large gift boxes), or above windows or cabinets.

In addition, the present invention provides for suitable packaging which conveniently and securely supports the decorative bow of the invention for shipping and/or display.

Various changes to the foregoing articles of manufacture and modifications in the described practices may be introduced without departing from the invention. The particularly preferred articles of manufacture and methods are thus intended in an illustrative and not limiting sense. The true spirit and scope of the invention is set forth in the following claims.

What is claimed is:

1. A decorative bow comprising six discrete pieces of ribbon and means for securing said pieces of ribbon together in the shape of a bow, wherein said six discrete pieces of ribbon include:

a first piece formed into a loop;

a second piece, larger than said first piece, said second piece formed into a loop and gathered;

a third piece, larger than said first piece, said third piece formed into a loop and gathered;

a fourth piece gathered but not formed into a loop;

a fifth piece gathered and folded so as to form an angle substantially less than 180°; and a sixth piece gathered and folded so as to form an angle substantially less than 180°.

2. A decorative bow according to claim 1, wherein said fourth piece of ribbon is provided behind said first and second pieces of ribbons.

3. A decorative bow according to claim 1, wherein said sixth piece of ribbon is larger than said fifth piece of ribbon and is provided behind said fifth piece of ribbon.

4. A decorative bow according to claim 1, wherein said bow includes no ribbon other than said first through sixth pieces.

5. A decorative bow according to claim 1, wherein said means for securing includes a fastener inserted through said loop formed of said first piece of ribbon.

6. A decorative bow according to claim 1, wherein each of said fifth and sixth pieces is folded so as to form an angle of less than 90°.

7. A decorative bow according to claim 1, further comprising:

a plastic rod secured to said fourth piece of ribbon; and a pair of attachment tabs mounted on said plastic rod.

8. A decorative bow according to claim 7, wherein:

said means for securing includes a fastener inserted through said loop formed of said first piece of ribbon; and said plastic rod has a notch extending vertically at a front side of said rod for receiving said fastener and a rib extending horizontally at a rear side of said rod for being inserted into a gather of said fourth piece of ribbon.

9. A decorative bow, consisting of:

a first piece of ribbon formed into a loop;

a second piece of ribbon, larger than said first piece, said second piece formed into a loop and gathered;

a third piece of ribbon, larger than said first piece, said third piece formed into a loop and gathered;

a fourth piece of ribbon, gathered but not formed into a loop;

a fifth piece of ribbon gathered and folded so as to form an angle substantially less than 180°;

a sixth piece of ribbon gathered and folded so as to form an angle substantially less than 180°;

a fastener inserted through said loop formed of said first piece of ribbon, said fastener twisted to secure together said six pieces of ribbon; and a plastic rod secured to said fourth piece of ribbon, said rod having a pair of attachment tabs at respective ends of said rod.

10. A decorative bow according to claim 9, wherein said plastic rod has a notch extending vertically at a front side of said rod for receiving said fastener and a rib extending horizontally at a rear side of said rod for being inserted into a gather of said fourth piece of ribbon.

11. A decorative bow according to claim 9, wherein said third piece of ribbon, before folding, is substantially equal in length to said fourth piece of ribbon.

12. A decorative bow according to claim 11, wherein each of said third and fourth pieces of ribbon is substantially longer than said other pieces of ribbon.

13. A mounting member for mounting a ribbon bow to a surface, comprising:

a rod;

a pair of mounting tabs, each at a respective end of said rod, for being attached to said surface;

a notch on a first side of said rod at a central portion of said rod, said notch extending in a direction transverse to a longitudinal axis of said rod, said notch for receiving a fastener for attaching said bow to said mounting member; and a rib on a second side of said rod, said second side opposite to said first side, said rib extending along said longitudinal axis of said rod and outwardly from said rod, said rib for being inserted into a gather of said ribbon bow.

14. A mounting member according to claim 13, wherein said rod is made of plastic.

15. A mounting member according to claim 14, wherein said rod, said tabs and said rib are formed as a single, integral piece of molded plastic.

* * * * *